United States Patent [19]

Raikhlin et al.

[11] Patent Number: 5,074,383

[45] Date of Patent: Dec. 24, 1991

[54] HOISTING MACHINE

[76] Inventors: Mark M. Raikhlin, prospekt, 9, kv. 89, Moscow, Volgogradsky; Yakov V. Baryba, shosse Entuziastov, 72, kv. 229, Balashikha, Moskovskaya oblast, both of U.S.S.R.

[21] Appl. No.: 576,454

[22] PCT Filed: Nov. 29, 1988

[86] PCT No.: PCT/SU88/00250

§ 371 Date: Sep. 18, 1990

§ 102(e) Date: Sep. 18, 1990

[87] PCT Pub. No.: WO90/06276

PCT Pub. Date: Jun. 14, 1990

[51] Int. Cl.[5] ..... B66B 11/04

[52] U.S. Cl. ..... 187/17; 187/2; 187/12; 187/95

[58] Field of Search ..... 187/2, 12, 15, 17, 94, 187/95

[56] References Cited

U.S. PATENT DOCUMENTS 4,522,129 6/1985 Jerberyd ..... 104/138 G

FOREIGN PATENT DOCUMENTS 2258065 7/1978 Fed. Rep. of Germany .
417082 2/1981 U.S.S.R. .
914467 3/1982 U.S.S.R. .
1051025 10/1983 U.S.S.R. .
2053150 2/1981 United Kingdom .

*Primary Examiner*—Robert P. Olszewski
*Assistant Examiner*—Dean A. Reichard
*Attorney, Agent, or Firm*—Lilling and Lilling

[57] ABSTRACT

A hoisting mechanism comprises a pole (1) with weight and build-up branches (2, 3) and carrying elements (4) in these branches (2, 3) and a mechanism (6) for moving the carrying elements (4) in the branches (2, 3) from one such branch to the other. The mechanism (6) includes a hydraulic cylinder (8) with two pins (12, 13), two pairs of pivotable stops (17, 18), a guide (30), and two pushers. Axes (19) of oscillation of the stops (17, 18) are positioned in their centers of gravity, whereas the guide (30) has the form of an oval cup (31) secured to a housing (7) of the mechanism (6), has a slot (33) in a bottom (32) and holes (37) in the side wall to receive the pushers.

3 Claims, 6 Drawing Sheets

HOISTING MACHINE

FIELD OF THE INVENTION

This invention relates generally to hoisting and transportation equipment, and more particularly to hoisting machines.

BACKGROUND OF THE INVENTION

There is known a hoisting machine comprising a vertical pole having a guide along which carrying elements move. Provided at the carrying element closest to the top of the pole is a bracket for attaching a weight thereto. The carrying elements are moved along the guide by a hydraulic cylinder positioned at the bottom of the pole. The carrying elements are brought close to the pole and removed therefrom manually (cf., SE, C, 417,082).

However, manual displacement of the carrying elements makes the machine less reliable in operation and complicates its servicing.

There is also known a hoisting machine comprising a tubular pole having weight and build-up branches extending in parallel along the pole and having carrying elements movable along the branches, a bracket for securing the weight bearing on the carrying element closest to the top of the pole, and a mechanism for moving the carrying elements along the branches and displacing them from one branch to the other positioned at the base of the pole.

This mechanism includes a vertical hydraulic cylinder having two rods and positioned so that the rods are coaxial with the build-up and weight branches, accordingly, and a horizontal hydraulic cylinder whose rod has a clamp means for gripping the carrying element to displace it from under one branch to the other branch, and further having spring-loaded pivotable stops under each branch provided with lugs for restricting, in the drawn-together position of the stops, the movement of the carrying elements under the force of gravity, and a removable sleeve fitted onto the first or second rod of the vertical hydraulic cylinder depending on the direction of movement.

Operation of this hoisting machine meets with difficulties associated with ensuring strictly alternate functioning of the vertical and horizontal hydraulic cylinders, which makes the machine less reliable. In addition, in order to draw the pivotable stops under the weight branch apart, the removable sleeve positioned at the rod of the vertical hydraulic cylinder coaxially with the weight branch takes up loads both vertically from the weight and carrying elements present, in the weight branch and horizontally as a result of friction between the lugs of the pivotable stops and end face of the carrying element proportional to the mass of the weight, which necessitates an extra force to be applied by the vertical hydraulic cylinder and results in excessive wear of the pivotable stops and surface of the removable sleeve.

There is further known a hoisting machine comprising a tubular pole with weight and build-up branches extending in parallel along the pole and having carrying elements capable of movement along the branches, a bracket for securing the weight to be lifted bearing on the carrying element closest to the top of the pole in the weight branch, a mechanism for moving the carrying elements lengthwise of the branches and displacing them from one branch to the other positioned at the base of the pole and having a housing accommodating a hydraulic cylinder positioned so that the axis of its rod runs in line with the axis of the weight branch, the rod having two pins coaxial with the respective branch, and a frame with rollers capable of travelling in a plane perpendicular to its axis in a direction from one pin to the other, whereby the frame can assume two extreme positions determining elevation or lowering of the weight, pivotable stops under each branch having lugs for restricting, in the drawn-together position of the stops, the movement of the carrying elements under the action of the force of gravity, and shaped surfaces intended to engage with the frame rollers, whereby as the rod of the hydraulic cylinder moves to the base of the branches the stops are drawn apart to disengage from the carrying elements, the spring mechanism for returning the stops to the drawn-together position, the guide means connected to the stops and determining the travel path of the carrying elements from one branch to the other, two-pushers capable of movement toward each other in a plane perpendicular to the axis of the cylinder rod and engagement with the side surface of the carrying element present in the guide means for transferring it from one branch to the other alternately kinematically linked each by way of a two-arm lever whose axis of oscillation is secured to the housing of the mechanism with the corresponding side of the frame in one of its extreme positions determining the direction of movement of the carrying elements in the branches of the pole.

This prior art hoisting mechanism further includes pairs of springs connected to each stop, one such spring being connected by a first end thereof to the housing of the mechanism, and by the other to the pivotable stop, the second spring being connected by the first end thereof to the piovotable stop and by the second end to the shaped surface which is part of a four-link chain defined by the pivotable stop, shaped surface, connection of the shaped surface to the pivotable stop, and connection of the spring end secured at the pivotable stop to the shaped surface (cf., SU, A, 1,051,025).

However, one disadvantage of this known machine is that it can operate only in the vertical position of the pole. For example, it is impossible to use the aforedescribed construction of the mechanism for moving the carrying elements in an inclined position, such as for pivoting the pole with a weight to be lifted to the vertical position. With the pole in an inclined position the pivotable stops are acted upon by a moment of force determined by a component force of the pull of gravity of the pivotable stops to result in bringing the stops inadvertently apart and consequently in opening of the guide means connected to the stops, and in the carrying element tending to get out of the guide means rendering the machine inoperable.

Therefore, the known hoisting machine necessitates accurate selection and adjustment of the springs of the spring mechanism for returning the pivotable stops to the drawn-together position ensuring that the carrying elements are reliably fixed in place, the pivotable stops are brought together and spread apart at the precise point of passing of the carrying elements whereas with the pole in an inclined position the equilibrium in the springs of the return mechanism can be disturbed to affect the reliability of the hoisting machine.

SUMMARY OF THE INVENTION

The present invention aims at providing a hoisting mechanism having such a construction of pivotable stops and guide means, which would ensure reliable functioning of these elements in an inclined position of the pole, as well as would make it possible to simplify balancing of pivotable stops.

The aims of the invention are attained by that in a hoisting machine comprising a tubular pole having weight and build-up branches extending in parallel along the pole and provided with carrying elements capable of movement along the branches, a bracket to secure the weight to be lifted bearing on the carrying element closest to the top of the pole in the weight branch, a mechanism for moving the carrying elements along the branches from one branch to the other positioned at the base of the pole and having a housing with a hydraulic cylinder secured therein so that the axis of its rod runs in line with the axis of the weight branch, the rod having two pins each positioned coaxially with one of the branches, and a frame with rollers capable of movement relative to the rod in a plane perpendicular to its axis in a direction from one pin to the other, whereby the frame can assume two extreme positions determining lifting or lowering of the weight, pivotable stops under the respective branches having lugs for restricting the movement of the carrying elements in the drawn-together position of the stops, and shaped surfaces engageable with rollers at the frame, whereby as the rod of the hydraulic cylinder moves toward the base of the pole the stops are drawn apart to disengage with the carrying elements, a spring mechanism for returning the stops to the drawn-together position, a guide means determining the travel path of the carrying elements from one branch to the other, two pushers capable of movement toward each other in a direction perpendicular to the axis of the rod of the hydraulic cylinder and engagement with the side surface of the carrying element present in the guide means for transferring it from one branch to the other, each alternately kinematically linked through a two-arm lever having its axis of oscillation secured to the housing of the mechanism with the corresponding side of the frame in one of its extreme positions determining the direction of movement of the carrying elements in the branches of the pole, according to the invention, axis of oscillation of the stops are positioned in their centers of gravity, whereas the guide means has the form of an oval cup secured at the housing of the mechanism for moving the carrying elements under the base of the pole with the open end thereof facing the openings of its branches having a slot in a bottom to ensure access of the pins to the end and holes in the side wall for providing access of the pushers to the side surface of the carrying element present in the cup.

It is advisable that the inner surface of the side wall of the cup is provided with spring-loaded locks arranged in opposition to each other and intended to prevent the carrying element against tipping over inside the cup.

It is also advisable that the spring mechanism for returning the stops has the form of a rocker whose axis of oscillation is secured at the housing of the mechanism, the spring mechanism having a handle to control its position, and two tension springs with first ends of each such spring connected to the corresonding arm of the rocker and second ends of each such spring connected to the corresponding pivotable stop.

The proposed hoisting mechanism can be used for handling weights both in the vertical position and in an inclined position of the pole, which is especially advantageous for erecting vertical structures by pivoting the pole of the machine about a hinge.

The lack of linkage between the guide means and pivotable stops, and securing the guide means immediately at the housing of the mechanism for moving the carrying elements ensures continuous orientation of the carrying element present in the guide means axially of the weight or build-up branch depending on the direction of travel of the carrying elements (elevating or lowering of the weight bracket). In addition, provision of locks in the guide means prevents skewing of the carrying element and tipping it over as it moves from under one branch to under the other branch.

Arranging the axis of the pivotable stops in their centres of gravity makes it possible to prevent extra loads exerted thereon by their own weight, whereby the use of an intricate system for balancing of the stops by springs with accurately preset spring force can be dispensed with.

Also, provision of spring mechanisms for returning the stops in the form of rockers having axis of oscillation thereof secured immediately at the housing of the mechanism for moving the carrying elements ensures reliable bringing together of the pivotable stops under the carrying elements present in the branches irrespective of the position of the pole.

BEST MODE OF CARRYING OUT THE INVENTION

Figure 1:
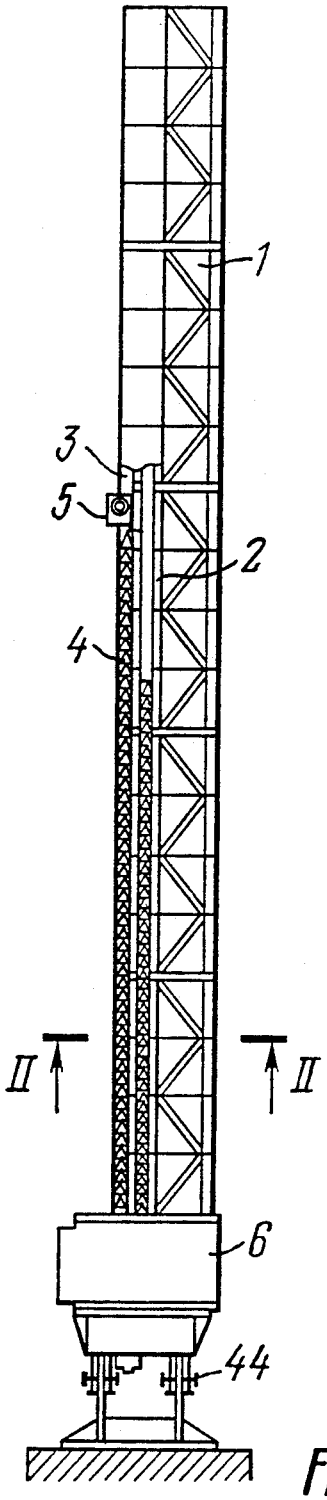
FIG. 1 is a partially sectional view of a hoisting mechanism according to the invention.
Figure 2:
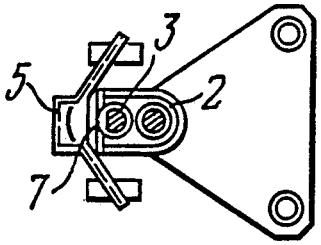
FIG. 2 is an enlarged sectional view taken along the line II—II in FIG. 1.
Figure 3:
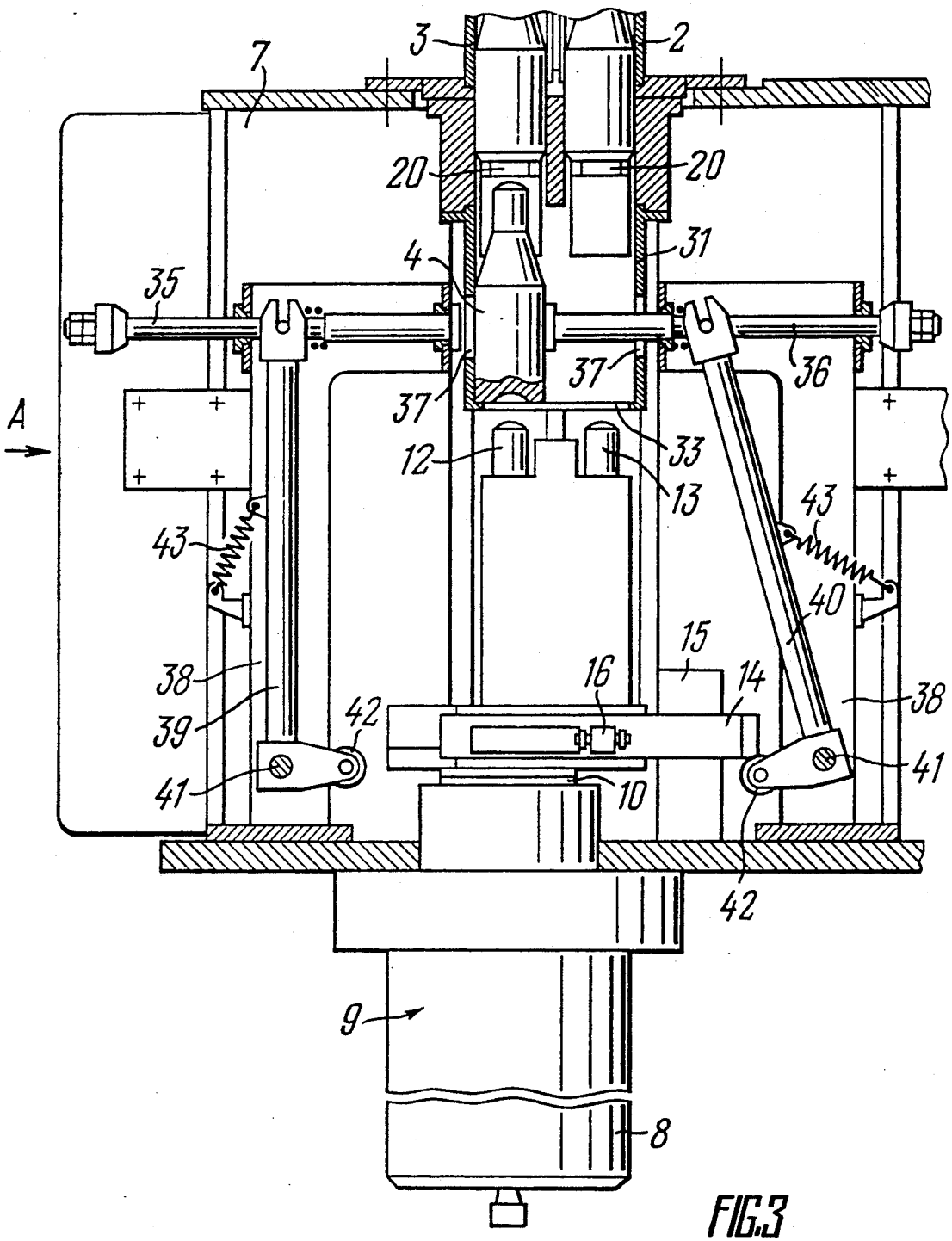
FIG. 3 is a partial longitudinal enlarged sectional view of a mechanism for moving the carrying elements.

A hoisting machine with reference to FIGS. 1 and 2 comprises a tubular pole 1 with two parallel branches 2 and 3 extending along the pole 1, the branch 3 being a weight branch, whereas the branch 2 is a build-up branch.

Carrying elements 4 are capable of movement along the branches 2 and 3; a bracket 5 intended for attaching a weight (not shown) to be lifted bears on the carrying element 4 closest to the top of the pole 1 in the weight branch 3.

Provided at the bottom part of the pole 1 is a mechanism 6 for moving the carrying element 4 along the branches 2 and 3, and from one branch 2 or 3 to the other.

The mechanism 6 has a housing 7 (FIGS. 3, 4, 5, 6) accommodating a hydraulic cylinder 8, this hydraulic cylinder 8 being positioned so that the axis 9 of its rod 10 runs in line with the axis of the weight branch 3. Two pins 12 and 13 are secured at the rod 10 of the hydraulic cylinder 8, the pin 12 extending coaxially with the weight branch 3, whereas the pin 13 is coaxial with the build-up branch 2.

The rod 10 has a frame 14 capable of movement relative to the rod 10 is guides 15 in a plane perpendicular to the axis 9 of the rod 10 in a direction from one pin 12 or 13 to the other, whereby the frame 14 can assume two extreme positions determining elevation or lowering of the weight.

The frame 14 carries spring-loaded rollers 16 engageable with two pairs of pivotable stops 17 and 18 with the axis 19 of oscillation thereof secured in the housing 7; these stops being positioned under the branches 2 and 3 with the stops 17 underlying the weight branch 3 and stops 18 underlying the build-up branch 2.

The pivotable stops 17 and 18 have the form of two-arm levers with the axis 19 of oscillations thereof arranged in their respective centers of gravity.

Ends of the pivotable stops 17 and 18 have lugs 20 engageable with the carrying elements 4 present in the branches 2 and 3 when the stops 17 and 18 are drawn together.

The lugs 20 act to prevent the movement of the carrying elements 4 under the force of gravity.

The stops 17 and 18 have shaped surfaces 21 along which the rollers 16 run, and consequently as the rod 10 of the hydraulic cylinder 8 moves toward the base of the pole 1 the frames move the stops 17 and 18 to a drawn-apart position in which they are brought out of engagement with the carrying elements 4.

Figure 4:
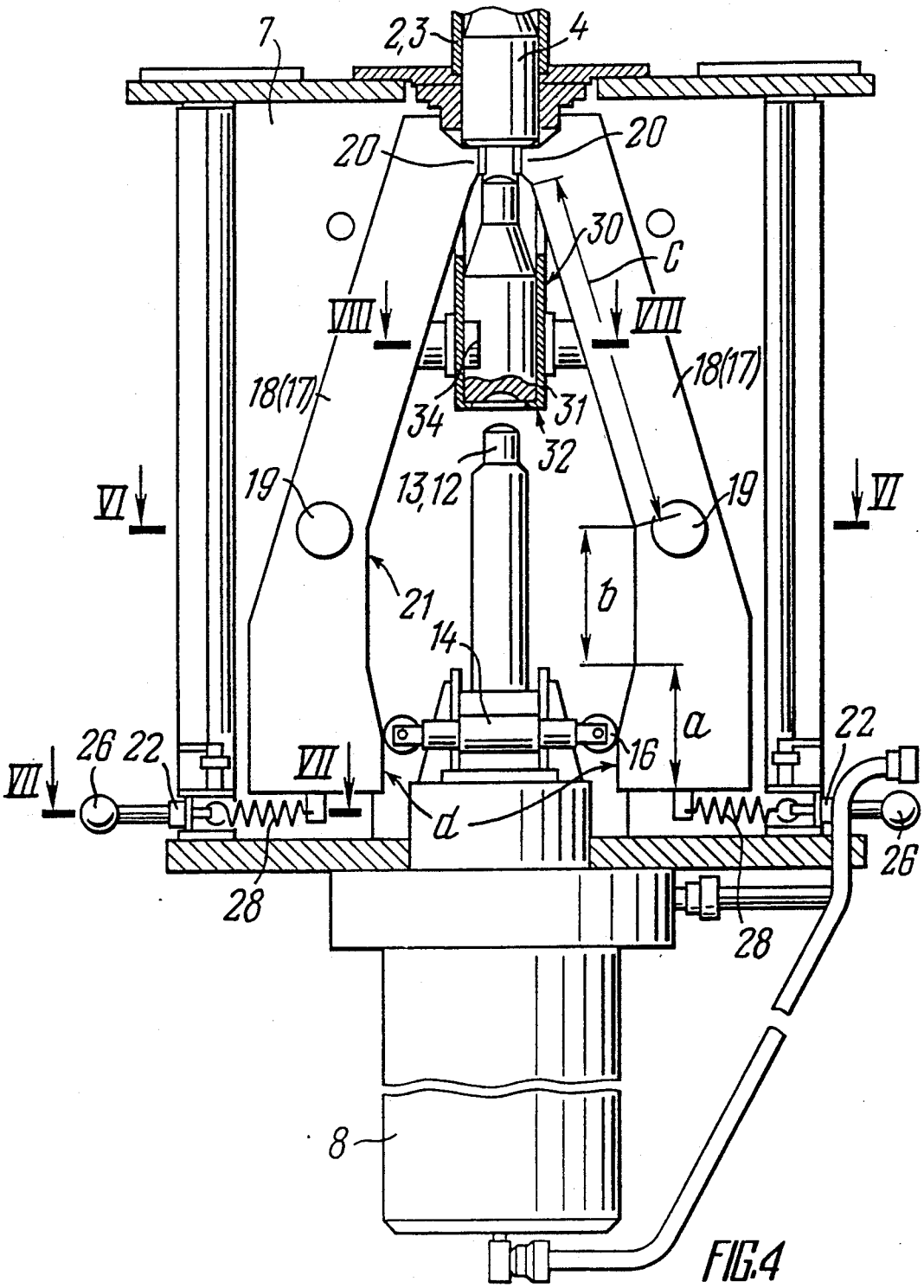
FIG. 4 is a partially longitudinal sectional view taken along the arrow A in FIG. 3.
Figure 5:
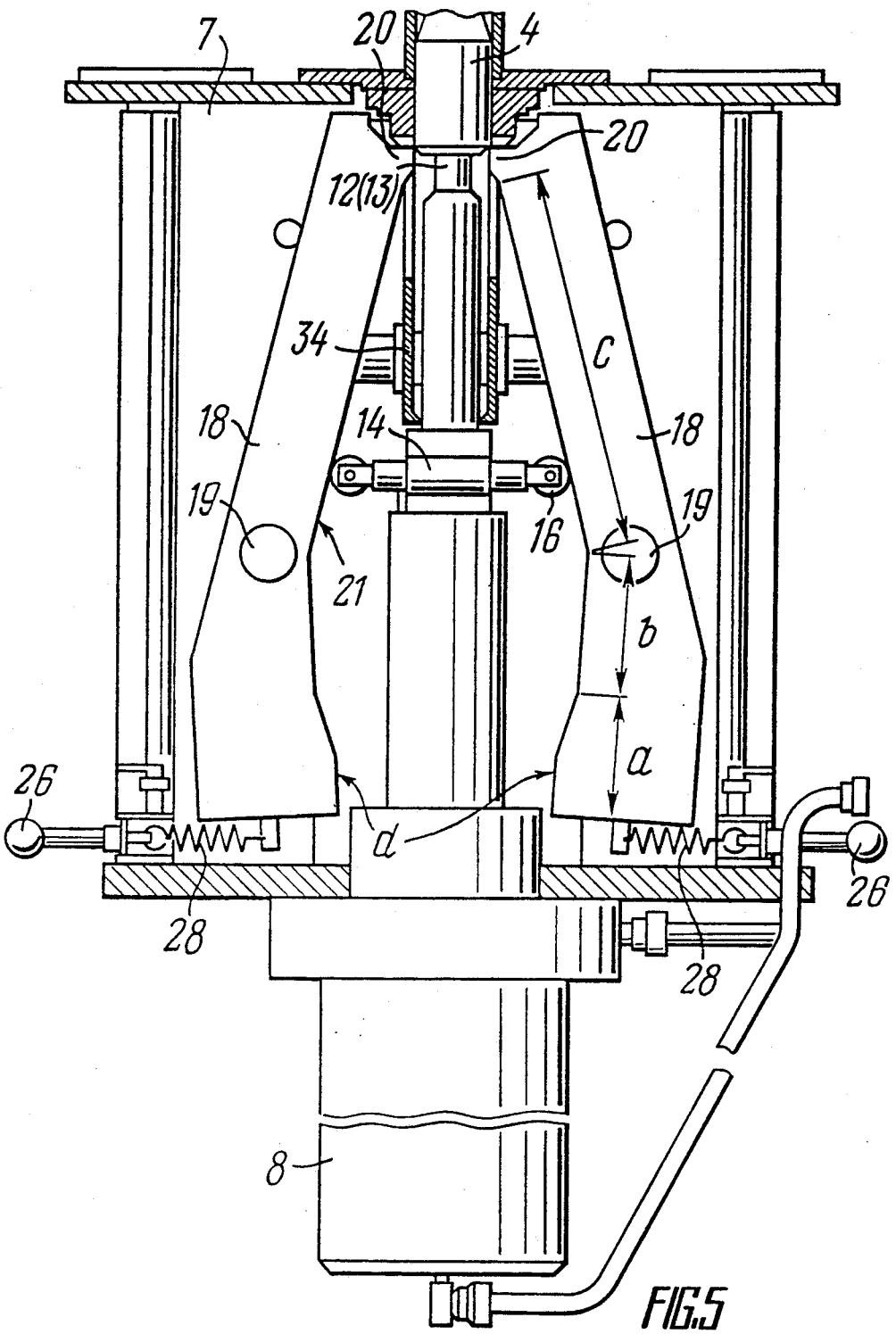
FIG. 5 shows the same as in FIG. 4 with the pivotable stops drawn apart.
Figure 6:
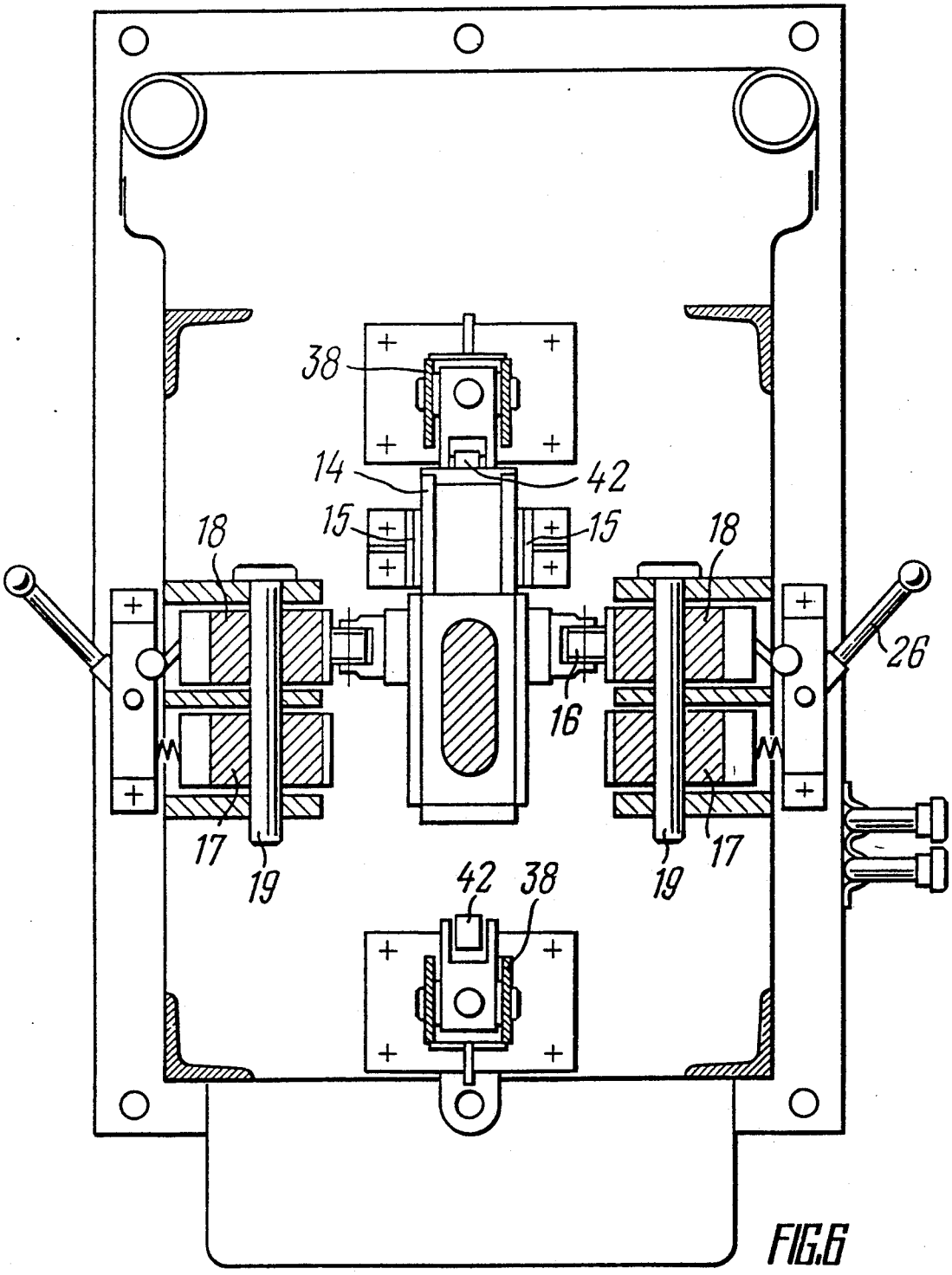
FIG. 6 is a section taken along the line VI—VI in FIG. 4.
Figure 7:
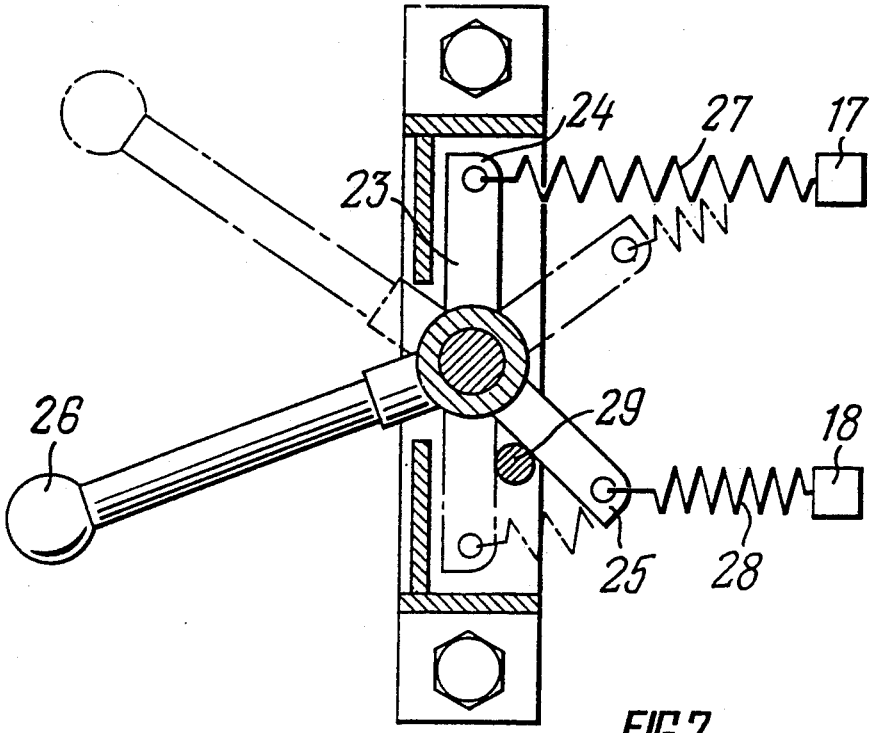
FIG. 7 is an enlarged sectional view along the line VII—VII in FIG. 4 of the mechanism for returning the stops.

Referring to FIGS. 4 and 7, the housing 7 accommodates a spring mechanism 22 to return the stops 17 and 18 to a drawn-together position, this mechanism 22 being made up of two parts, each including a rocker 23 with arms 24 and 25, a handle 26, and tension springs 27 and 28, first ends of the springs 27 and 28 being connected to the lower ends of the corresponding stops 17 and 18, whereas the second ends are connected to the respective arms 24 and 25 of the rocker 23. In order to fix the rocker 23 in position, there is provided an extensible pin 29. The axis of oscillation of the rocker 23 is secured to the housing 7 of the mechanism 6.

Figure 8:
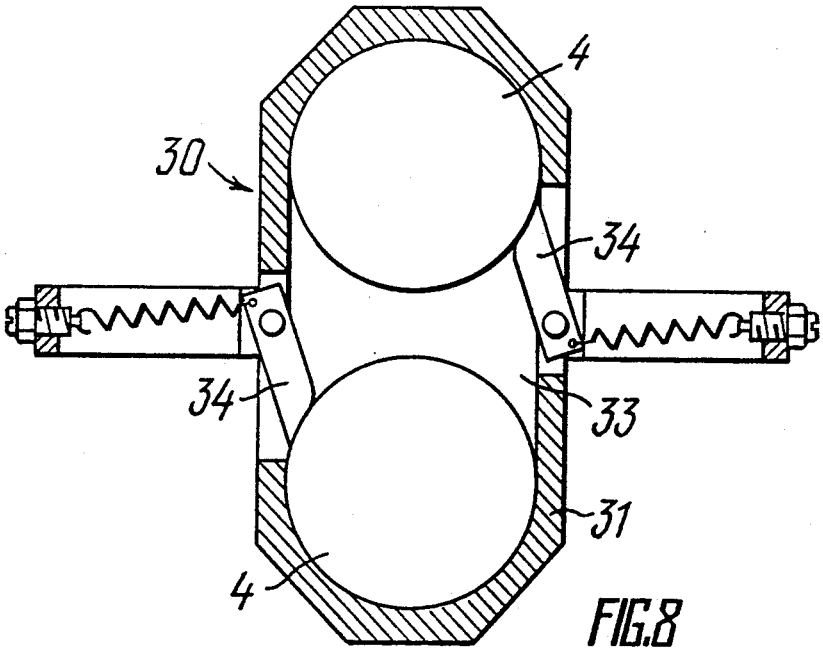
FIG. 8 is an enlarged view of a guide means taken along the line VIII—VIII in FIG. 4.

The housing 7 of the mechanism 6 also accommodates a guide means 30 (FIGS. 4 and 8) which determines the travel path of the carrying elements 4 from one branch, such as branch 3, to the other branch 2, and vice versa.

The guide means 30 is fashioned as a generally oval cup member 31 secured under the base of the branches 2 and 3 at the housing 7 of the mechanism 6 for moving the elements 4, the open end of the cup member 31 being arranged in line with the branches 2 and 3.

A bottom 32 (FIG. 4) of the cup 31 has a slot 33 for the pins 12 and 13 to extend therethrough toward the ends of the lower carrying elements 4 present in the branches 2, 3.

Spring-loaded lock means 34 are provided at the inner wall surface of the cup 31 in opposition to each other to prevent the carrying element 4 from tipping over inside the cup 31.

The mechanism 6 for moving the elements 4 further includes two pushers 35 (FIG. 3) and 36 positioned in the housing 7 so as to be capable of moving toward each other in a plane perpendicular to the axis 9 of the rod 10 of the hydraulic cylinder 8 through holes 37 made in the wall of the cup 31 to engage with the side surface of the carrying element 4 present in the cup 31.

The pushers 35 and 36 provide movement of the carrying element 4 present in the cup 31 from under the branch 2 (3) to under the branch 3 (2).

The pushers 35, 36 move in guide sleeves secured at the top portions of L-shaped brackets 38 rigidly connected to the housing 7 and operatively connected each to the frame 14 in its extreme positions by two-arm levers 39, 40. Axis 41 of oscillation of the levers 39 and 40 are also positioned at the brackets 38. The pusher 35 is pivotably connected to one arm of the lever 39, the end of the other arm thereof having a roller 42 engageable with the end of the frame 14 in one of its extreme positions, whereas the pusher 36 is connected in a similar manner to one arm of the lever 40, the other end of this arm carrying a roller 42 engageable with the opposite end of the frame 14 in its other extreme position. The two-arm levers 39, 40 have tension springs 43 connected to the housing of the mechanism 6.

The hoisting machine operates in the following manner.

A weight or rigging to be lifted is attached to the bracket 5 (FIG. 1) in its bottom position, the build-up branch 2 being completely filled with the carrying elements 4, the lowest element 4 bearing on the lugs 20 (FIG. 4) of the stops 18 underlying the build-up branch 2. One of the carrying elements 4 rests in the guide means 30, bears on its bottom 32, and is fixed in place by the spring-loaded lock means 34 under the weight branch 3.

The frame 14 (FIG. 3) is shifted to the right (toward the build-up branch 2) to engage with the roller 42 of the spring-loaded two-arm lever 40. This position of the frame 14 corresponds to lifting the weight.

The pusher 36 extends to force the carrying element 4 to the wall of the cup 31 (the element 4 is under the weight branch 3). The rollers 16 (FIG. 4) of the frame 14 engage with the portion "a" of the shaped surface 21 at the lower portion of the stops 18.

Prior to hoisting the weight the handles 26 (FIGS. 4, 7) of the spring mechanism 22 are set to a position in which the springs 27 connected to the stops 17 under the weight branch 3 are extended, thereby bringing together the stops 17 under the branch 3.

After actuating the hydraulic cylinder 8 (FIG. 3) its rod 10 with pins 12 and 13 starts to extend, the frame 14 mounted on the rod 10 is brought out of engagement with the roller 42 of the spring-loaded lever 40 for the latter to return to the initial position under the action of the spring 43. The pusher 36 leaves the cup 31 through the hole 37, since the pusher 36 is pivotably connected to the lever 40.

During a further movement of the rod 10 with pins 12 and 13 these pins enter the cup 31 through the hole 33 in its bottom, the pin 12 forcing the carrying element 4 in the cup 31 upwards, the carrying element 4 acts to spread the lugs 20 of the stops 17 closing the openings of the weight branch 3 to enter the weight branch 3, exert action on the carrying element 4 with the bracket 5 bearing thereon, and move this carrying element 4 along the weight branch 3 to a height equalling the height of the carrying element 4.

In the course of further travel of the rod 10 (FIG. 4) upwards the carrying element 4 which entered the weight branch 3 is raised over the lugs 20 of the stops 17 drawn together by the springs 27 of the spring mechanism 22.

Concurrently, the pin 13 (FIG. 5) elevates the lower carrying element 4 present in the build-up branch 2 over the lugs 20 of the stops 18 causing them to spread under the action of the spring-loaded rollers 16.

As the rod 10 with pins 12 and 13 is lowered, the carrying element 4 delivered to the weight branch 3 runs on one the lugs 20 of the stops 17, whereas the lower carrying element 4 present in the build-up branch 2 starts to descend bearing on the pin 13, the spring-loaded rollers 16 tending to run along the section "C" of the shaped surface 21 of the stops 18 to hold them and consequently lugs 20 in the drawn-apart position ensuring the movement of the lower carrying element 4 from the branch 2 to the cup 31.

With a further lowering of the rod 10 the rollers 16 move to the portions "δ" of the surface of the stops 18 turn the latter relative to the axis 19, whereby the lugs 20 are drawn together to close the opening of the build-up branch 2 retaining the carrying elements 4 and preventing them against falling under the force of gravity.

After the carrying element 4 conveyed from the build-up branch 2 rests at the bottom 32 of the cup 31 and after a further lowering of the rod 10 with frame 14 the frame 14 exerts pressure on the roller 42 of the spring-loaded lever 40, which turns to move the pusher 36 to the interior of the cup 31. The pusher 36 shifts the carrying element 4 from under the branch 2 to under the weight branch 3 where it is locked against tipping over by the spring-loaded locks 34.

The reciprocating movement of the rod 10 causes automatic displacement of the carrying element 4 from the build-up branch 2 to the weight branch 3 accompanied by elevation of the bracket 5.

For lowering the bracket 5 it is necessary to bring the handle 26 of the spring mechanism 22 to the opposite side, whereby the spring 28 connecting the end 25 of the rocker 23 to the stop 18 will stretch, and also to move the frame 14 to the left for ensuring its engagement with the opposite roller 42 of the spring-loaded lever 39 and consequently movement of the pusher 35.

The spring-loaded rollers 16 of the frame 14 will engage with the shaped surface 21 of the other pair of stops, particularly with stops 17 under the weight branch 3.

Therefore, reciproaction of the rod 10 ensures transfer of the carrying elements 4 from the weight branch 3 to the build-up branch 2 and lowering of the bracket 5.

The hoisting machine can operate in an inclined position when mounted on a base or on a vehicle and hingedly connected thereto.

The weight is pivotably connected to the bracket 5.

The bracket 5 is moved along the pole 1 as heretofore described accompanied by reliable transfer of the carrying elements 4 from the build-up branch 2 to the weight branch 3 and vice versa.

The carrying element 4 moves in the guide means 30 from under the line of one branch 2 (3) to under the other branch 3 (2) irrespective of the position of the machine, as the guide means 30 is rigidly affixed to the housing 7 and is not connected to the pivotable stops 17 and 18.

The lock means 34 prevents the carrying element 4 inside the guide means 30 against skewing regardless of the position of the rod 1 with branches 2 and 3.

The pushers 35, 36 moving the carrying element 4 inside the guide means, viz., cup 31, and secured in the guide sleeves of the L-shaped brackets 38 function reliably irrespective of the position of the pole 1.

In addition, the pivotable stops 17 and 18 reliably close the lines of the corresponding branches 2 and 3 at any position of the pole 1, including the inclined position, as the axis 19 oscillation of the stops 17, 18 are positioned in their center of gravity, thereby preventing extra loads resulting from the weight of the stops 17, 18 capable of spreading the stops 17 and 18 apart. Another accompanying advantage resides in dispensing with accurate selection and adjustment of the springs 27 and 28 of the spring mechanism 22 for returning the stops to the initial position.

The spring mechanism 22 for returning the stops 17 and 18 to the drawn-together position is secured at the housing 7 of the mechanism 6, and therefore the position of the pole 1 fails to affect its operation.

In view of the aforedescribed, regardless of the position of the pole 1 (vertical or inclined) the carrying elements 4 will be reliably transferred from one branch 2 or 3 to the other to consequently move the bracket 5 carrying the weight.

INDUSTRIAL APPLICABILITY

The proposed hoisting machine can be used with success in any industrial field to assist in mounting heavy equipment, particularly for erecting vertical structures.

We claim:

1. A hoisting machine comprising a tubular pole (1) having weight and build-up branches (2, 3) extending in parallel along the pole (1) and provided with carrying elements (4) capable of moving along the branches (2, 3), a bracket (5) for securing a weight bearing on the carrying element (4) closest to the top of the pole (1) in the weight branch (3), a mechanism (6) for moving the carrying elements (4) along the branches (2, 3) from one branch (2 or 3) to the other positioned at the base of the pole (1) and having a housing (7) with a hydraulic cylinder (8) secured therein so that the axis (9) of its rod (10) runs in line with the axis of the weight branch (3), the rod (10) having two pins (12, 13) each positioned coaxially with one of the branches (2, 3) and a frame (14) with rollers (16) capable of movement relative to the rod (10) in a plane perpendicular to its axis (9) in a direction from one pin (12 or 13) to the other, whereby the frame (14) can assume two extreme positions determining lifting or lowering of the weight, pivotable stops (17, 18) under the respective branches (2, 3) having lugs (20) for restricting the movement of the carrying elements (4) in a drawn-together position of the stops (17, 18), and shaped surfaces (21) engageable with rollers (16) of the frame (14), whereby as the rod (10) of the hydraulic cylinder (8) moves toward the base of the pole (1) the stops (17, 18) are drawn apart to disengage with the carrying elements (4), a spring mechanism (22) for returning the stops (17, 18) to the drawn-together position, a guide means (30) determining the travel path of the carrying elements (4) from one branch (2 and 3) to the other, two pushers (35, 36) capable of movement toward each other in a direction perpendicular to the axis (9) of the rod (10) of the hydraulic cylinder (8) and engagement with a side surface of the carrying element (4) present in the guide means (30) for transferring it from one branch (2 or 3) to the other, each alternately kinematically linked through a two-arm lever (39, 40) having its axis of oscillation secured to the housing (7) of the mechanism (6) with the corresponding side of the frame (14) in one of its extreme positions determining the direction of movement of the carrying elements (4)

in the branches (2, 3) of the pole (1), characterized in that axis (19) of oscillation of the stops (17, 18) are positioned in their center of gravity, whereas the guide means (30) has the form of an oval cup (31) secured at the housing (7) of the mechanism (6) for moving the carrying elements (4) under the base of the pole (1) with an open end facing openings of branches (2, 3) and having a slot (33) in a bottom (32) to ensure access of the pins (12, 13) to a bottom end of the carrying element (4) present in the cup (31), and holes in the side wall for providing access of the pushers (35, 36) to the side surface of the carrying element (4) present in the cup (31).

2. A hoisting machine as claimed in claim 1, characterized in that the inner surface of the side wall of the cup (31) is provided with spring-loaded locks (34) arranged in opposition to each other and intended to prevent the carrying element (4) from tipping over inside the cup (31).

3. A hoisting machine as claimed in claim 1, characterized in that the spring mechanism (22) for returning the stops (17, 18) has the form of a rocker (23) whose axis of oscillation is secured at the housing (7) of the mechanism (6), the spring mechanism having a handle (26) to control its position, and two tension springs (27, 28) with first ends of each such spring connected to the corresponding arm (24, 25) of the rocker (23) and second ends of each such spring connected to the corresponding stop (17, 18).

* * * * *